United States Patent [19]

Zehren

[11] 4,171,934

[45] Oct. 23, 1979

[54] CABLE-SUSPENDED, LINER-SUPPORTED SUBMERGIBLE PUMP INSTALLATION WITH LOCKING DISCHARGE HEAD

[75] Inventor: James N. Zehren, Bartlesville, Okla.

[73] Assignee: TRW Inc., Cleveland, Ohio

[21] Appl. No.: 903,601

[22] Filed: May 8, 1978

[51] Int. Cl.[2] ..... F04D 29/60; F04D 29/62; F21B 23/00

[52] U.S. Cl. ..... 417/360; 415/501; 166/217

[58] Field of Search ..... 417/360; 415/501; 166/216, 217

[56] References Cited

U.S. PATENT DOCUMENTS

| | | | |
|---|---|---|---|
| 1,875,357 | 9/1932 | Simmons | 166/217 |
| 2,941,599 | 6/1960 | Daffin | 166/219 |
| 3,180,420 | 4/1965 | Manson et al. | 166/133 |
| 3,250,331 | 5/1966 | Boyle | 166/133 |
| 3,411,454 | 11/1968 | Arutunoff | 417/360 X |
| 3,593,784 | 7/1971 | Brown et al. | 166/217 X |
| 3,853,430 | 12/1974 | O'Rourke | 417/360 |

*Primary Examiner*—Carlton R. Croyle
*Assistant Examiner*—R. E. Gluck
*Attorney, Agent, or Firm*—Shapiro and Shapiro

[57] ABSTRACT

A submergible electric pump has a discharge head provided with a locking device for locking the discharge head to a well liner. The locking device comprises a plurality of lugs that are projected into a groove in the well liner when the pump is lowered through the liner to an operative position, at which the discharge head is sealed in the liner. The discharge head has inner and outer tubular members, the outer member seating on the liner and being held against rotation relative to the liner. The inner member continues to move downwardly after the outer member is seated, camming the locking lugs outwardly through windows in the outer member and into the liner groove. The lugs provide support for the weight of the pump installation and prevent rotation between the inner and outer members of the discharge head.

9 Claims, 8 Drawing Figures

CABLE-SUSPENDED, LINER-SUPPORTED SUBMERGIBLE PUMP INSTALLATION WITH LOCKING DISCHARGE HEAD

BACKGROUND OF THE INVENTION

This invention is concerned with submergible pump installations, and more particularly with a submergible pump having a discharge head that automatically locks into a well liner.

The present invention is an improvement upon the invention disclosed and claimed in U.S. Pat. No. 3,853,430, issued Dec. 10, 1974, assigned to the same assignee as this invention, and incorporated herein by reference. The prior patent discloses a cable-suspended, submergible electric pump installation in which the pump discharge head has a locking device for locking the discharge head to a well liner, so that the pump installation cannot be dislodged by bottom hole pressure. The locking device employs generally cylindrical rollers which are cammed outwardly beneath a shoe at the lower extremity of the liner when an outer member of the discharge head seats in the liner and an inner member continues to move downwardly. The discharge head employs seals between the inner and outer members to isolate the locking rollers from the high pressure discharge of the pump, in addition to external seals between the outer member and the liner shoe. Pins fixed to the outer member extend into longitudinal grooves on the inner member to prevent rotation of one member relative to the other. In the commercial embodiment of this apparatus, rotation between the outer member and the liner is prevented by mutually engaging teeth on the outer member of the discharge head and a shoulder of the liner.

The foregoing apparatus provides many advantages over earlier submergible pump installations, particularly in the ability to prevent unseating of the pump installation by bottom hole pressure. However, the rollers used as the locking elements are hard to contain and serve only as locking elements. The entire weight of the pump installation and the column of pumped fluid is supported by an internal shoulder of the liner, so that the internal diameter of the liner is limited by the need for providing a shoulder wide enough to carry the load. Special elements must be provided to resist the torque produced when the pump is operated that tends to cause rotation between the inner and outer members of the discharge head. Multiple O-ring seals are employed, and these lack resistance to abrasive materials found in many wells.

BRIEF DESCRIPTION OF THE INVENTION

It is accordingly a principal object of the present invention to provide an improved submergible pump installation with a self-locking discharge head.

Another object of the invention is to provide an improved submergible pump installation in which locking elements of the discharge head provide support for the weight of the pump installation and the column of fluid above the discharge head.

A further object of the invention is to provide an improved submergible pump installation with a simplified mechanism for preventing rotation of the discharge head and the parts thereof in the well.

A further object of the invention is to provide an improved submergible pump installation having better external seals and requiring no internal seals.

Yet another object of the invention is to provide improved apparatus which performs the functions of a downhole packer, a discharge packer and a lock-down device within a well liner and which permits substantially unrestricted pumping of fluid at high volumes.

Briefly stated, in accordance with a preferred form of the invention a submergible pump having a discharge head at its upper end is lowered into a well through a tubular liner. The discharge head has outer and inner coaxial tubular members, the inner being coupled to the outer member for limited upward and downward movement relative thereto. The outer member is supported on a shoulder in the liner when the pump is at its operative position and has sealing means providing a seal between the outer member and the liner. Cooperating teeth on the shoulder and the outer member prevent rotation of the outer member relative to the liner. The inner member continues to move downwardly after the outer member is seated, causing locking lugs to be cammed outwardly through windows in the outer member and to engage a liner groove. The lugs, which are supported on the inner member, prevent rotation between the inner and outer members and provide support for the pump installation on the liner. Each lug has a base trapped in a conical channel between the inner member and a surrounding sleeve fixed thereto, the sleeve having slots open at the top for receiving the lugs.

BRIEF DESCRIPTION OF THE DRAWINGS

The invention will be further described in conjunction with the accompanying drawings, which illustrate a preferred and exemplary embodiment, and wherein.

DETAILED DESCRIPTION OF THE INVENTION

Figure 1:
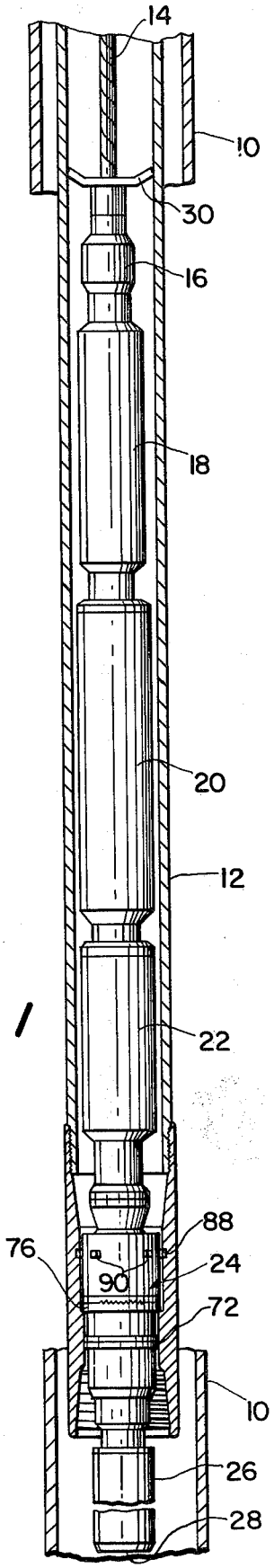
FIG. 1 is a longitudinal sectional view of a pump installation in accordance with the invention shown in place in a well casing.

As snown in FIG. 1 of the drawings, the invention is concerned with a submergible pump installation in a well, the casing 10 of which is shown fragmentarily. The casing extends downwardly from the usual wellhead at the earth's surface and preferably contains a separate cylindrical liner 12 spaced inwardly from the casing 10 and approximately coaxial therewith. The liner may be supported upon the wellhead and extends downwardly to a level at which a discharge head of the pump is to be located when the pump is in its operative position in the wall. Alternatively, the casing 10 may constitute the liner, and the term "liner" is intended to encompass the casing itself as well as an additional tubular member.

The submergible pump is preferably lowered into the well through the liner 12 by means of a cable 14, which may include weight-supporting strands as well as insulated electrical conductors, the latter normally being sealed from the fluid within the well. If desired, separate weight-supporting and electrical cables may be employed, or the pump may be lowered into the well from tubing. In the illustrative pump installation, weight-supporting strands of cable 14 are anchored within a cable socket 16 (which may be of the type shown in U.S. Pat. No. 3,424,484, for example). Suspended colinearly from the cable socket 16, in the embodiment shown, are a pothead or splicing chamber 18, an electric motor 20, a motor protector 22, a discharge head 24, and a centrifugal or turbine pump 26 having an intake 28 at the bottom. A rubber sand check 30 may also be provided. Further details of a submergible pump installation per se are found in U.S. Pat. No. 3,672,795, for example, incorporated herein by reference.

Figure 2:
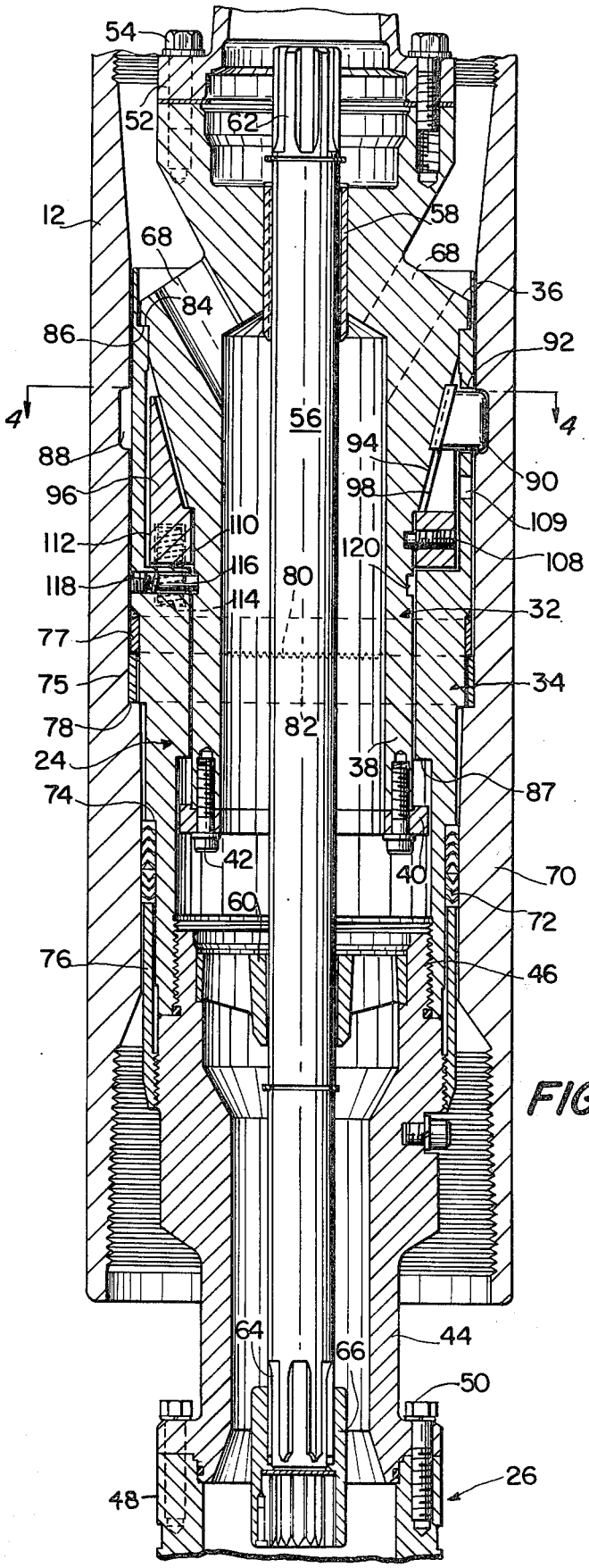
FIG. 2 is a longitudinal sectional view of a discharge head shown seated upon a well liner in accordance with the invention.

As shown in FIG. 2, the discharge head 24 comprises a tubular inner member 32 and a tubular outer member 34. The inner member has a top wall 36, which may be integral with a side wall 38. A collar 40 is affixed to the lower end of the inner member by means of screws 42. The outer member 34 has a base 44 affixed to its lower end by means of threads 46. The lower end of base 44 is secured to the housing 48 of the pump 26 by means of screws 50 and is sealed thereto. The upper end of the inner member 32 is secured to the housing 52 of the motor protector 22 by means of screws 54.

The discharge head 24 is hollow, providing adequate space for passing the pump shaft 56, which extends from the motor 20 (FIG. 1) through the motor protector 22 and coaxially through the discharge head 24 to the pump 26. The pump shaft, which is supported for rotation in the discharge head by bushings 58 and 60, is sectional, the sections being splined at 62 and 64 and being connected by means of couplings 66, at least one of which telescopes to permit a degree of elongation or contraction of the shaft.

The hollow interior of the discharge head 24 provides substantially unrestricted high-volume flow of fluid from the pump through the discharge head to a series of discharge ports 68 in the top wall 36 of the discharge head, the ports having sufficient cross-sectional area to continue the flow without restriction.

Liner 12 has an internal annular shoe 70. The outer member 34 of the discharge head has an external seal 72 that engages and seals upon shoe 70. Seal 72 preferably comprises a stack of V-rings which are mounted on the outer member between a downwardly-facing external shoulder 74 and the end of a retainer sleeve 76 threaded onto base 44. A highly effective seal is thus easily provided.

As the pump 26 and associated components are lowered into the well, the outer member 34 of the discharge head is suspended from collar 40 on the inner member (see FIG. 3), the collar forming a lifting ring for later lifting of the outer member by the inner member if the pump is withdrawn from the well. The pump 26 is dimensioned to pass through the shoe. After the pump passes through the shoe, the seal 72 enters and seals against the shoe. A ring 77 fixed externally to outer member 34 of the discharge head then seats upon a ring 75 fixed to the liner. Ring 75 is preferably supported on a shoulder 78 and constitutes an extension of the shoulder. Ring 77 has downwardly extending teeth 80 which mesh with upwardly extending teeth 82 of ring 75 as the rings engage one another. Thereafter, outer member 34 of the discharge head cannot rotate in liner 12.

When the outer member 34 of the discharge head becomes seated on shoulder 78 of the liner, the weight of the pump installation on the inner member 32 causes the inner member to move downwardly relative to the outer member as cable 14 contines to be fed into the well. This downward movement of the inner member is limited by engagement of external downwardly-facing shoulder 84 of the inner member with internal upwardly-facing shoulder 86 of the outer member. Upward movement of the inner member relative to the outer member is limited by engagement of the lifting ring 40 with a downwardly-facing internal shoulder 87 of the outer member.

To lock the discharge head 24 in the well, liner 12 is provided with an annular internal groove 88 that receives locking lugs 90 mounted on the discharge head and movable inwardly and outwardly through windows 92 provided in the outer member 34. The upper portion of side well 38 of the inner member is tapered to provide an inverted conical outer surface 94. The lower portion of side wall 38 is preferably cylindrical, as shown, to fit within the surrounding portion of the outer member. A sleeve 96 surrounds the tapered upper portion of side wall 38 and has an internal conical surface 98 that is spaced from and that complements the external conical surface 94. The vertex angle of each conical surface may be about 30°.

Figure 6:
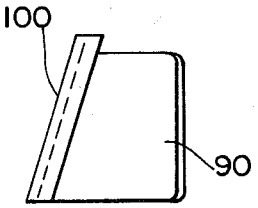
FIGS. 6–8 are, respectively, a side elevation view, a front elevation view, and a bottom plan view of a locking lug employed in the invention.
Figure 7:
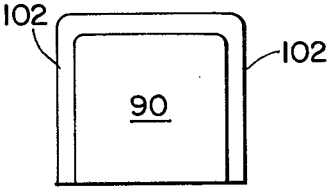
Figure 8:
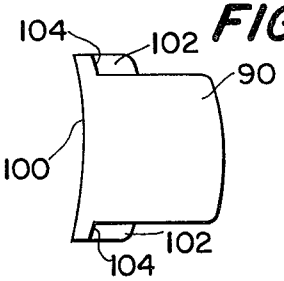

As shown in FIGS. 6–8, each lug 90 has a base with a curved inner surface 100. Lateral extensions 102 of the base have curved outer surfaces 104. Each lug is preferably a generally rectangular block of steel with its integral base oriented and shaped so that its curved surfaces 100 and 104 mate with the tapered surfaces 94 and 98 as shown in FIG. 4.

Figure 4:
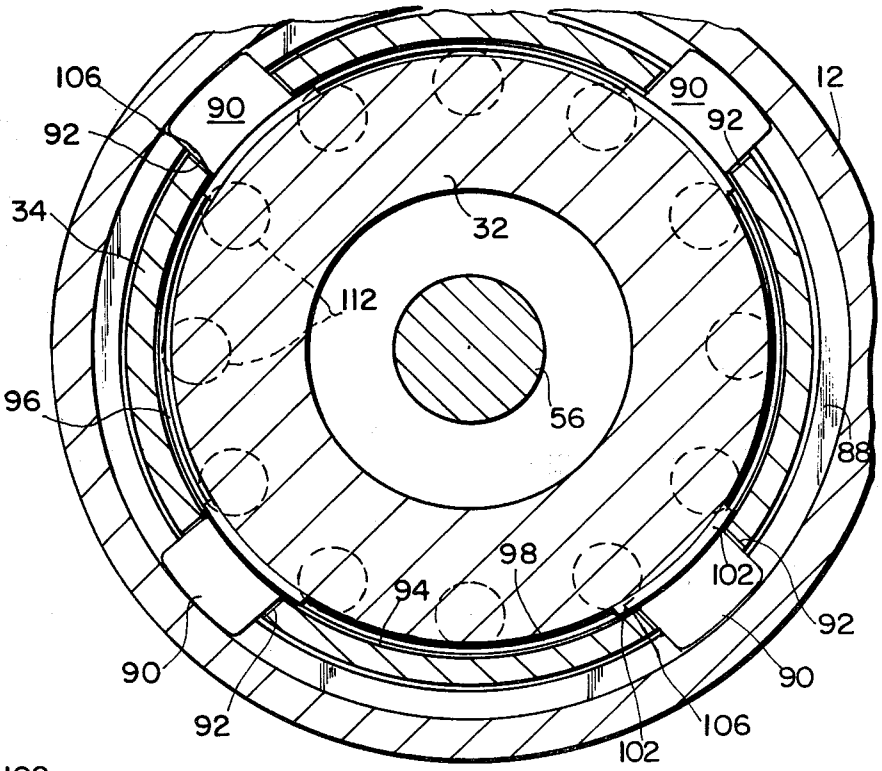
FIG. 4 is a horizontal sectional view taken along line 4—4 of FIG. 2, somewhat enlarged.
Figure 5:
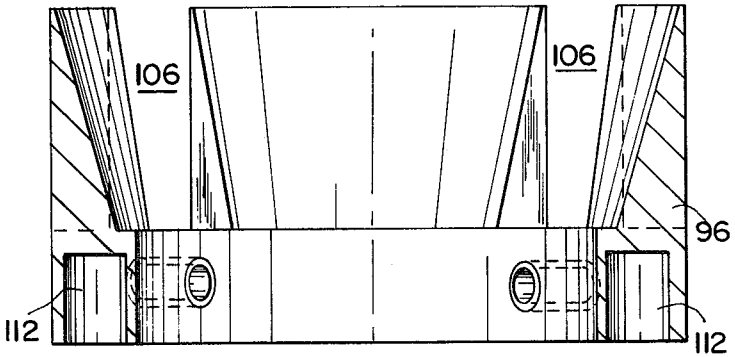
FIG. 5 is a vertical sectional view illustrating a sleeve employed in the invention.

As shown in FIGS. 4 and 5, sleeve 96 has a plurality of longitudinal slots 106 corresponding to the lugs 90, respectively. In the illustrative embodiment, four slots spaced equally about the circumference of the sleeve are used, although different numbers of lugs and slots may be employed. Slots 106 are open at the top. The lower end of sleeve 96 forms a ring that is secured to the inner member 32 of the discharge head by means of screws 108, as shown in FIG. 2. It is apparent that sleeve 96 may be slipped over the cylindrical portion of side wall 38 of the inner member before lifting ring 40 is attached to the inner member and that lugs 90 may be inserted in the slots from the top, the lateral extensions 102 of the bases of the lugs trapping the lugs in the conical channel defined by spaced surfaces 94 and 98. Access to screws 108 is provided by holes 109 in outer member 34 when inner member 32 and sleeve 96 are appropriately positioned relative to the outer member. Lugs 90 may reciprocate in their slots 106 while projecting into windows 92 and thereby preventing rotation of the inner member 32 relative to the outer member 34. Thus neither the discharge head nor its parts will rotate in the well liner despite the torque exerted on the housings of the pump and pump motor when the pump is driven.

Figure 3:
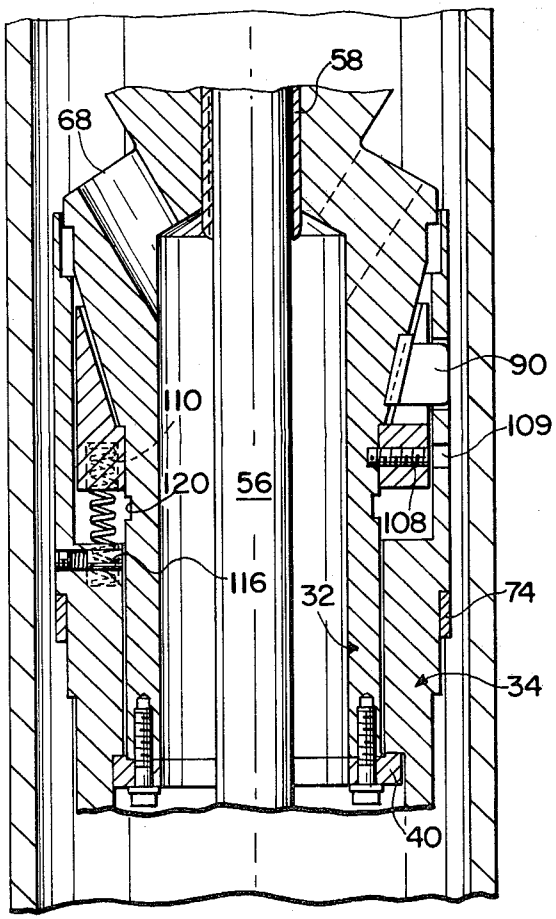
FIG. 3 is a view similar to FIG. 2, but showing the relative positions of inner and outer members of the discharge head as the pump is lowered into the well.

While the pump and associated components are lowered into the well, lugs 90 will be retracted as shown in FIG. 3, still remaining in windows 92. Downward movement of inner member 32 relative to outer member 34 after the outer member becomes seated on shoulder 78 causes the conical surfaces 94 and 98 to move downwardly relative to the lugs 90, camming the lugs outwardly into groove 88 of the liner.

To assist in maintaining shoulders 84 and 86 apart, as shown in FIG. 3, while the pump is lowered into the well, compression springs 110 may be employed. Opposite ends of an appropriate number of circumferentially spaced springs may be held in aligned recesses 112 and 114 of sleeve 96 and outer member 34, respectively. The weight of the pump installation on the inner member 32 of the discharge head is sufficient to overcome the bias of springs 110 when the outer member 34 is seated in the liner, compressing the springs as shown in FIG. 2. Thereupon shear pins 116 mounted radially in bores through the outer member 34 are projected inwardly by springs 118 into an annular groove 120 on inner member 32, fixing the position of the inner member relative to the outer member as shown in FIG. 2. If it is desired to remove the pump from the well, the pulling force on cable 14 must be sufficient to shear the pins 116, so that inner member 32 can move upwardly relative to outer member 34, camming lugs 90 inwardly and forcing the lugs to retract from groove 88, so that when the lifting ring 40 engages shoulder 87, the discharge head is unlocked from the liner.

By virtue of the invention, a submergible pump installation is provided with a simple automatically locking discharge head that prevents unseating of the pump installation by bottom hole pressure, especially when a safety valve (not shown) permits bottom hole pressure to build up against the pump. A highly effective stacked V-ring seal, which resists abrasion, is provided, and internal seals are not required. There is little tendency of the pump discharge to enter between the inner and outer members of the discharge head, since the flow through the head is unrestricted, and there is little pressure drop across the locking lugs. The external V-ring seal is easily mounted on the discharge head, because the locking lugs are above the seal and do not interfere. Since the locking lugs support some of the weight of the pump installation and the column of pumped fluid above the discharge head, the liner shoulder can be smaller, permitting an increase in the diameter of the flow path through the discharge head. The locking lugs are easily mounted on the discharge head and are easily contained. Once mounted in slots 106 and windows 92, the lugs remain there.

While a preferred embodiment of the invention has been shown and described, it will be apparent to those skilled in the art that changes can be made in this embodiment without departing from the principles and spirit of the invention, the scope of which is defined in the appended claims. For example, although in the preferred embodiment the pump is located at the bottom of the pump installation, with the motor above, the motor (and motor protector) may be located below the pump, as indicated in FIG. 10 of the aforementioned U.S. Pat. No. 3,853,430. In that event, electrical conductors (rather than a pump shaft) may pass through the discharge head.

I claim:

1. Apparatus for providing a pump installation in a well, comprising a tubular liner in the well having an internal annular shoe and an internal shoulder above the shoe, a submergible pump dimensioned to pass through the shoe and having a discharge head at its upper end, means for lowering the pump through the liner to an operative position below the shoe, the discharge head having a tubular outer member connected to a housing of the pump and having a coaxial tubular inner member coupled to the outer member for limited upward and downward movement relative thereto, the outer member having means for supporting it on said shoulder when the pump is at said operative position and having sealing means providing a seal between the outer member and the shoe, the inner member having a top wall with discharge ports therethrough, the outer member and said shoulder having cooperating teeth which engage one another when the pump is at said operative position for preventing rotation of the outer member relative to the liner, and locking means for automatically locking the discharge head to the liner when the pump is at its operative position, the locking means comprising an annular groove inside the liner above the shoulder and a plurality of cooperating lugs supported on the discharge head, the lugs being mounted in corresponding windows through the outer member of the discharge head for inward and outward movement, the inner member having a surrounding sleeve fixed thereto, the sleeve having a plurality of longitudinal slots, each of which receives a corresponding lug for reciprocative movement along the length of the slot while the lug projects into the associated window, thereby preventing rotation of the outer member relative to the inner member, each of the lugs having a base trapped in a channel between the inner member and the sleeve, the channel being oriented upwardly and outwardly to cause the lugs to move outwardly through the windows when the inner member moves downwardly with respect to the outer member, whereby the lugs are projected into the liner groove to lock the discharge head to the liner and to provide support for the pump installation in the liner, the weight of the installation on the inner member being sufficient to move the inner member downwardly with respect to the outer member automatically when the outer member seats on the shoulder of the liner.

2. Apparatus in accordance with claim 1, wherein a portion of the inner member has a conical outer surface and the sleeve has a complementary conical inner surface surrounding the conical outer surface and spaced therefrom to provide the channel for the base of the lugs, and wherein the base of each lug is wider than the slot in which the lug reciprocates and has curved surfaces mating with said conical surfaces, respectively.

3. Apparatus in accordance with claim 2, wherein the sleeve has a lower end connected to the inner member.

4. Apparatus in accordance with claim 1, wherein the lower extremity of the inner member is surrounded by a lift ring and wherein the outer member has an internal downwardly-facing shoulder located to be engaged by the lift ring when the inner member is lifted relative to the outer member and thereby to limit the upward movement of the inner member relative to the outer member.

5. Apparatus in accordance with claim 1, wherein the installation includes a motor for driving the pump and the top wall of the inner member is connected to the motor, and wherein a drive shaft for the pump extends axially through the discharge head from the motor to the pump and is supported for rotation in the discharge head, there being sufficient space between the shaft and surrounding surfaces of the discharge head to provide a substantially unrestricted flow path from the pump through the discharge head.

6. Apparatus in accordance with claim 1, wherein the sealing means comprises a stack of V-rings surrounding the outer member and held between an external downwardly-facing shoulder on the outer member and the upper end of a sleeve threaded over the outer member.

7. Apparatus in accordance with claim 1, wherein the means for lowering the pump comprises a cable.

8. A self-locking discharge head for a submergible pump installation suspended in a tubular liner, said discharge head having a tubular outer member with means for connecting it to a pump housing and having a coaxial tubular inner member coupled to the outer member for limited upward and downward movement relative thereto, the outer member having means for supporting it on a shoulder of the liner when the pump is at an operative position and having sealing means providing a seal between the outer member and the liner, the inner member having a top wall with discharge ports therethrough, and locking means for automatically locking the discharge head to the liner when the pump is at its operative position, the locking means comprising a plurality of lugs supported on the discharge head and mounted in corresponding windows through the outer member of the discharge head for inward and outward movement, the inner member having a surrounding sleeve fixed thereto at the lower end of the sleeve, the sleeve having a plurality of longitudinal slots open at the top, each of which receives a corresponding lug through its open top for reciprocative movement along the length of the slot while the lug projects into the associated window, each of the lugs having a base trapped in a channel between the inner member and the sleeve, the channel being oriented upwardly and outwardly to cause the lugs to move outwardly through the windows when the inner member moves downwardly with respect to the outer member, whereby the lugs are projected outwardly for locking the discharge head to the liner, the weight of the installation on the inner member being sufficient to move the inner member downwardly with respect to the outer member automatically when the outer member seats on the shoulder of the liner.

9. Apparatus in accordance with claim 8, wherein the sleeve is fixed to the inner member by means of screws and the outer member has holes therethrough providing access to the screws.

* * * * *